US010982438B2

(12) United States Patent
Li et al.

(10) Patent No.: US 10,982,438 B2
(45) Date of Patent: Apr. 20, 2021

(54) FRAME TUBE RECOMBINATION COVER PLATE FOR CAST-IN-SITU WALL CORE BUILDING BLOCK MOLD

(71) Applicants: Guangfu Li, Sichuan (CN); Xingwu Chen, Guangdong (CN)

(72) Inventors: Guangfu Li, Sichuan (CN); Xingwu Chen, Guangdong (CN)

( * ) Notice: Subject to any disclaimer, the term of this patent is extended or adjusted under 35 U.S.C. 154(b) by 0 days.

(21) Appl. No.: 16/833,751

(22) Filed: Mar. 30, 2020

(65) Prior Publication Data

US 2020/0248448 A1 Aug. 6, 2020

Related U.S. Application Data

(63) Continuation of application No. PCT/CN2017/105234, filed on Oct. 2, 2017.

(51) Int. Cl.

| | |
|---|---|
| ***E04B 1/00*** | (2006.01) |
| ***E04B 5/16*** | (2006.01) |
| ***E04B 5/43*** | (2006.01) |

(52) U.S. Cl.
CPC . *E04B 5/16* (2013.01); *E04B 5/43* (2013.01)

(58) Field of Classification Search
None
See application file for complete search history.

(56) References Cited

U.S. PATENT DOCUMENTS

| | | | | |
|---|---|---|---|---|
| 1,550,810 A * | 8/1925 | Jabelonsky | E04B 5/36 | 52/577 |
| 1,627,009 A * | 5/1927 | Berry | E04B 5/43 | 264/33 |
| 1,764,042 A * | 6/1930 | Goldsmith | E04B 5/36 | 52/127.3 |
| 1,846,197 A * | 2/1932 | Goldsmith | E04B 5/36 | 52/577 |
| 1,970,457 A * | 8/1934 | Jenkinson | E04B 5/43 | 52/251 |
| 2,003,670 A * | 6/1935 | Walker | E04C 5/163 | 52/236.6 |
| 2,084,648 A * | 6/1937 | MacMillan | E04B 5/43 | 52/650.3 |

(Continued)

FOREIGN PATENT DOCUMENTS

| | | |
|---|---|---|
| CN | 1928283 A | 3/2007 |
| CN | 200985574 | 12/2007 |

(Continued)

*Primary Examiner* — Basil S Katcheves

(57) ABSTRACT

The present invention discloses a frame tube recombination cover plate for a cast-in-situ wall core building block mold, including a bearing type cover plate and a partition type cover plate, wherein a plurality of flat plates on upper surfaces of model walls corresponding to the two types of cover plates for the cast-in-situ wall core building block mold are removed; more than three flat plates (2) perpendicularly connected with front and rear flat plates are equidistantly added between left and right outer edges of the front and rear flat plates (1) at intervals; then, the left and right outer edges of the front and rear flat plates (1) are connected with a plurality of lower convex semi-circular tubes (8) below; and hollow sections of semi-cylinders (9) of the lower convex semi-circular tubes (8) below the flat plates (2) added to one of the left and right sides are blocked.

1 Claim, 1 Drawing Sheet

(56) References Cited

U.S. PATENT DOCUMENTS 2,084,649 A * 6/1937 MacMillan ..... E04B 5/43
52/650.3

FOREIGN PATENT DOCUMENTS

| | | | |
|---|---|---|---|
| CN | 202689278 | U | 1/2013 |
| CN | 202731051 | U | 2/2013 |
| WO | 2005010292 | A1 | 2/2005 |

* cited by examiner

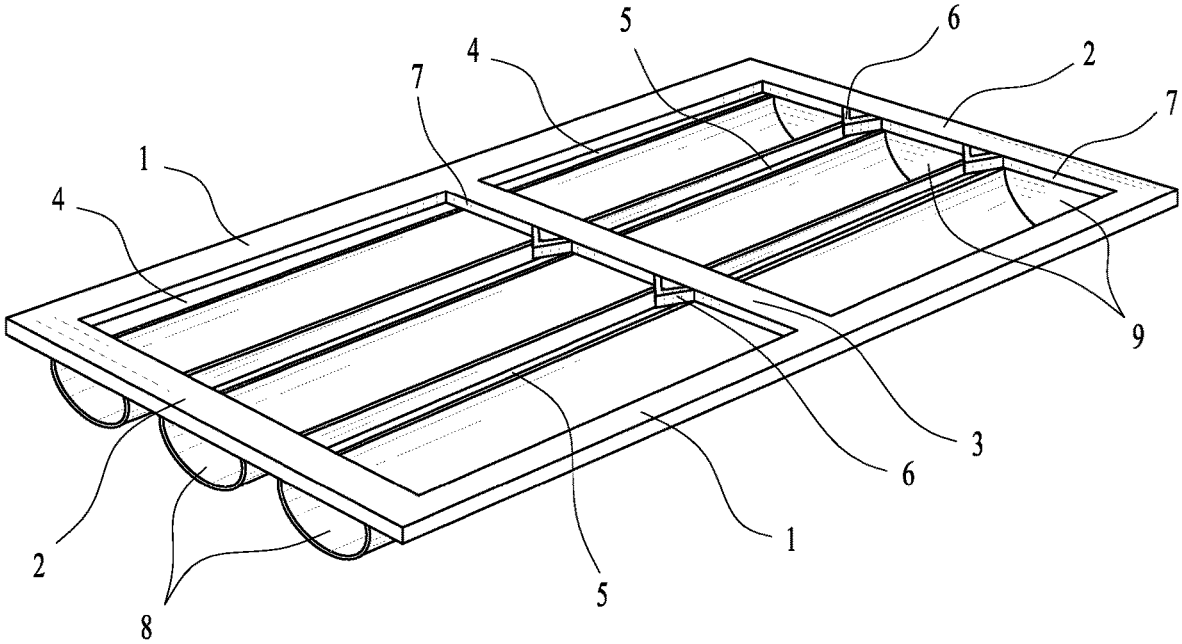
5
6
4
2
7
7
1
4
9
3
6
1
2
5
8

FRAME TUBE RECOMBINATION COVER PLATE FOR CAST-IN-SITU WALL CORE BUILDING BLOCK MOLD

CROSS-REFERENCE TO RELATED APPLICATIONS

This application is a continuation of International Application No. PCT/CN2017/105234 with a filling date of Oct. 2, 2017, designating the United states.

TECHNICAL FIELD

The present invention discloses a frame tube recombination cover plate for a cast-in-situ wall core building block mold, and relates to a cover plate for a building block mold, in particular to a cover plate for a cast-in-situ wall core building block mold (the building block and the mold are patent-pending products with an international application number of PCT/CN2015/077470).

BACKGROUND OF THE PRESENT INVENTION

Based on the technical solution of the existing cast-in-situ wall core building block mold, each of two types of three cast-in-situ wall core building blocks is adopted to build model walls, of which several rows and columns of parallel and merged left and right starting and ending wall tops are consistent; each cast-in-situ wall core building block mold with shapes and sizes of a layer of several rows and columns of building blocks are respectively designed according to the shape and size of each model wall; upper surfaces of each row of building blocks of each model wall are respectively connected in tandem to form the cover plate of each mold; a 30 cm long bevel cover plate is cut from the cover plate of each type of mold and is inclined upwards by 45°; a lower convex semi-circular arc surface is changed into a lower convex semi-elliptical arc surface which can be matched and intersected with the upper surface of respective model wall; and then, the bevel cover plate is fixed as a scraper of each type of mold to replace the cover plate, thereby making way for a feed port of each mold. Based on the technical solution of an existing method for manufacturing cast-in-situ wall core building blocks (that is a patent-pending method with the international application number of PCT/CN2015/077470), left and right baffle plates of the same type of mold are fixed at upper ends of left and right templates; foam concrete raw material slurry is injected into an empty mold from the feed port; the left and right baffle plates are removed after the raw material slurry is initially solidified and formed; front and rear steel balls of the same type of scraper are poured into front and rear concave steel grooves in outer surfaces of the front and rear templates from one of left and right sides and are horizontally moved to the other side, thereby scraping off excess semi-cylinder raw materials; and then, other subsequent operations are performed to obtain the cast-in-situ wall core building block. The mold is relatively complex in scraper and other related components, troublesome to operate, large in amount of raw materials to be scraped, large in waste, incapable of being overlapped up and down in multiple layers, large in occupied area, rough in upper surface of the obtained cast-in-situ wall core building block, and poor in sizing precision. Therefore, the technical solution for the scraper and other related components of the existing cast-in-situ wall core building block mold is not ideal enough. The part of the technical solution can be further improved and the corresponding operation method can be changed to reduce the cost and obtain a more ideal upper surface shape of the cast-in-situ wall core building block.

SUMMARY OF THE PRESENT INVENTION

To obtain a more ideal upper surface shape of a cast-in-situ wall core building block by optimizing an existing cast-in-situ wall core building block mold and a manufacturing method thereof, a plurality of rectangular flat surface plates (referred to as flat plates) on the upper surface of a model wall corresponding to a cover plate for a cast-in-situ wall core building block mold is removed from a frame tube recombination cover plate for a cast-in-situ wall core building block mold (referred to as the cover plate); more than three flat plates perpendicularly connected with front and rear flat plates and having an equal thickness are equidistantly added between left and right outer edges of the front and rear flat plates at intervals to form a rectangular flat frame; then, the left and right outer edges of the front and rear flat plates are connected with a plurality of lower convex semi-circular tubes below; and hollow sections of semi-cylinders of the plurality of lower convex semi-circular tubes at one of left and right sides are blocked. The cover plate is covered on assembled and fed uncovered molds, so that the excess part of expanded foam concrete raw material slurry in the molds overflows into the plurality of lower convex semi-circular tubes from the front and rear edges of rectangular hollow sections of the cover plate; and then, the cover plate is horizontally removed to one side of a non-blocking semi-cylinder to obtain an upper surface shape of the cast-in-situ wall core building block.

The following technical solution is adopted to solve technical problems of the frame tube recombination cover plate for the cast-in-situ wall core building block mold in the present invention. In the technical solution of the existing cast-in-situ wall core building block mold, bearing type and partition type cover plates for the cast-in-situ wall core building block mold have the same length as mold frames; lower surfaces are combination surfaces in which front and rear wider rectangular plane surfaces and a plurality of middle equal-width rectangular plane surfaces are connected with front and rear edges of a plurality of lower convex semi-arc surfaces with equal diameter and width at intervals; upper surfaces are combination surfaces corresponding to the lower surfaces; front and rear wider flat plates formed between the upper and lower surfaces have the same thickness as a plurality of middle equal-width flat plates; a plurality of lower convex semi-circular tubes have the same tube thickness; the lower surfaces within the front and rear edges of the front and rear wider flat plates and the plurality of middle equal-width flat plates are connected with the upper surfaces with front and rear tube thicknesses of the plurality of lower convex semicircular tubes; the front and rear wider flat plates are respectively formed by connecting front and rear flat plates with narrow-inner-edge flat plates; the width of the front and rear flat plate respectively corresponds to and is equal to the thickness of front and rear templates of the mold frame; the width of the narrow-inner-edge flat plate respectively corresponds to and is equal to the sum of the thickness of a longitudinal solid part in the front of a front row of building blocks or in the back of a rear row of building blocks in the mold frame, the diameter of an inner edge cutting steel wire of an adjacent mold frame and the tube thickness of the lower convex semicircular tube; the width of each of the plurality of middle equal-width flat plates corresponds to and is equal to the sum of the thickness of the longitudinal solid part of adjacent front and rear edges between several rows of building blocks in the mold frame, the diameter of the adjacent middle cutting steel wire and the tube thickness of the lower convex semicircular tubes at the adjacent front and rear edges; and the outer diameter of each of the plurality of lower convex semicircular tubes corresponds to and is equal to the diameter of a transverse hole of a middle semi-cylinder of the thickness of each row of building blocks in the mold frame. The narrow-inner-edge flat plates and the plurality of middle equal-width flat plates of front and rear wider flat plates of the existing cover plate for the cast-in-situ wall core building block mold are removed in the cover plate (the description refers to a patent-pending cast-in-situ wall core building block and mold and manufacturing method thereof with the international application number of PCT/CN2015/077470, in which names, orientations, preferred shapes and preferred sizes of related components are still consistent with the original description). More than three flat plates perpendicularly connected with the front and rear flat plates and having an equal thickness are equidistantly added between left and right outer edges of the front and rear flat plates at intervals to form a rectangular flat frame; then, the left and right outer edges of the front and rear flat plates are connected with the plurality of lower convex semi-circular tubes below; front and rear rectangular hollow sections are formed in spaces of a rectangular flat frame where the narrow-inner-edge flat plates are removed outside the flat plates; a plurality of middle rectangular hollow sections are formed in the spaces in which the plurality of middle equal-width flat plates are removed; hollow sections of semi-cylinders of the plurality of lower convex semi-circular tubes below the flat plates added to one of the left and right sides are blocked and fixed; equal hypotenuses of isosceles right triangle angle steel are respectively fixed at a plurality of middle rectangular hollow sections on inner edge lines at the same side of the flat plates added to one side and the middle of the blocked semi-cylinder; the height of the angle steel is equal to the thickness of the connected flat plate; a hypotenuse flat plate is respectively fixed at front and rear rectangular hollow sections and is connected with two adjacent right-angle-edge flat plates to form a symmetrical congruent isosceles right triangle; and the height of the hypotenuse flat plate is equal to the thickness of the connected flat plate. The cover plate includes the bearing type and partition type cover plates. For the two types of cover plates, the width of the outer edge between the front and rear flat plates is equal to the width of the outer edge of each of the same type of three mold frames; however, the length of the outer edge between the left and right added flat plates is only equal to a distance between thickness center lines of the left and right templates of two types of short special-shaped building block molds; both left and right ends are shorter than the lengths of the outer edges of two types of base plates and mold frames and longer than the lengths of the inner edges of two types of base plates and mold frames, so that the two types of cover plates can respectively form empty containers with sealed peripheries and rectangular hollow sections together with the same type of three mold frames, base plates and vertical and horizontal circular tube plates; the components constituting the empty container on each mold base are overlapped up and down in several layers on the two types of bases; and then the base plate of the previous layer of mold and the load thereon can be lifted from the position above the left and right outer edges of the next layer of cover plate. The two types of cover plates are covered on each of the same type of three assembled and fed uncovered molds from the bottom up layer by layer, so that the excess part of gradually expanded foam concrete raw material slurry in the each layer of containers in the two types of molds automatically overflows into the plurality of lower convex semi-circular tubes from the front and rear edges of the front and rear rectangular hollow sections and a plurality of middle rectangular hollow sections of each layer of cover plate, and continues to overflow from one side of the non-blocking semi-cylinder; then, the cover plate is horizontally removed to one side of the non-blocking semi-cylinder from top to bottom layer by layer; excess wastes not overflowed are poured from one side of the non-blocking semi-cylinder; and upper surface shapes of several rows and columns of cast-in-situ wall core building blocks in the two types of molds are obtained at the same time. All components of the cover plate can be made of plastic materials to reduce cost and deadweight, can also be made of metal materials to enhance strength, and even can be made of composite materials of plastic and metal to reduce the cost and deadweight and further enhance the strength.

Taking the bearing type and partition type cast-in-situ wall core building block molds corresponding to the minimum unit model walls of the bearing type and partition type cast-in-situ wall core building blocks as an example, the specific size of each component of the bearing type and partition type cover plates respectively corresponds to the size of a corresponding part of the bearing type and partition type cast-in-situ wall core building block molds. For the rectangular flat frame, the lengths of the outer edges are all 127.5 cm (the building block length 120 cm+three columns of longitudinal partition plates×the plate thickness 0.5 cm+a total of one left and right template×the plate thickness 6 cm); the widths of the outer edges are 72.4 cm (the building block width 60 cm+four cutting steel wires×the diameter 0.1 cm+a total of two front and rear templates×the plate thickness 6 cm) and 72.6 cm (the building block width 60 cm+six cutting steel wires×the diameter 0.1 cm+a total of two front and rear templates×the plate thickness 6 cm) respectively; the widths of the front and rear rectangular hollow sections are all 2.6 cm (the thickness 2 cm of the longitudinal solid part on one of the front and rear sides of the building block+the diameter 0.1 cm of the cutting steel wire on the inner edge of the mold frame+the thickness 0.5 cm of the lower convex semicircular tube on one of the front and rear sides); the widths of the middle rectangular hollow sections are all 5.1 cm (the thickness 4 cm of the longitudinal solid part on the front and rear sides of the building block+the diameter 0.1 cm of the middle cutting steel wire+the thickness 1 cm of the convex semicircular tubes on the front and rear sides); the length of the rectangular short side of each flat plate of the rectangular flat frame is 6 cm; and the thickness of each flat plate and the heights of the isosceles right triangle angle steel and the hypotenuse flat plate are all 2.5 cm. For the isosceles right triangle angle steel, the thicknesses of two right-angle sides are all 0.5 cm; and the length of the hypotenuse is 5.1 cm. The hypotenuse flat plates are all 0.5 cm thick and 3.7 cm long (one digit after decimal point is reserved for the approximate value, and the length of the right-angle side of the isosceles right triangle enclosed by the hypotenuse flat plate and the two adjacent right-angle side plates is 2.6 cm). The number of the lower convex semi-circular tubes is 3 and 5 respectively; the lengths are all 127.5 cm; the tube outer diameters are 16 cm and 8 cm respectively; and the tube inner diameters are 15 cm and 7 cm respectively. The diameters of the blocked semi-cylinders are 15 cm and 7 cm respectively; and the lengths are all 6 cm.

The frame tube recombination cover plate for the cast-in-situ wall core building block mold of the present invention has beneficial effects that the cover plate and an operation method thereof can replace and are superior to functions of the left and right baffle plates, the scraper and the concave front and rear steel ball grooves in the outer surfaces of the front and rear templates in the technical solution of the existing cast-in-situ wall core building block mold. When the cast-in-situ wall core building block is produced by the left and right baffle plates, the scraper and the corresponding manufacturing method in the cast-in-situ wall core building block mold, the cover plate for the mold cannot be covered after injecting unfilled foam concrete raw material slurry into the assembled empty mold because of waiting for gradually expanded raw material slurry to fill up spaces of transverse holes of a plurality of semi-cylinder between the left and right baffle plates and allowing excess raw material slurry to overflow from the upper edge of the mold; and the mold cannot be overlapped in multiple layers from the bottom up during production, thereby increasing the occupied area. To obtain the upper surface shape of the cast-in-situ wall core building block, the cover plate for the mold has to be simplified into a scraper; and the raw material slurry filled in the spaces of the transverse holes of the plurality of semi-cylinders between the left and right baffle plates is scraped by horizontal left and right movement, thereby causing more wastes. When scraping, the lower surface of a bevel cover plate of the scraper is in contact with the initially solidified raw material slurry in a closed combined line segment so that a rough cutting surface is formed on a combined type upper surface of the cast-in-situ wall core building block. Due to inevitable existence of certain gaps between the front and rear steel balls of the scraper and the front and rear steel ball grooves and larger wear of the two during use, the scraper is inevitably influenced by irregular resistance to move upwards or forwards and backwards when scraping the raw materials, so that the combined type upper surface shape of the cast-in-situ wall core building block is irregular. The left and right baffle plates, the scraper, the concave front and rear steel ball grooves in the outer surfaces of the front and rear templates and other related components designed to obtain the upper surface shape of the cast-in-situ wall core building block are relatively complex; particularly, the least used lower convex semi-elliptical tube of the bevel cover plate of the scraper must be inclined by 45° to be matched and intersected with the combined type upper surface of the model wall, and the concave front and rear steel ball grooves in the outer surfaces of the front and rear templates must be matched with the sizes of the steel balls, so that the manufacturing difficulty and cost are relatively high and the precision is difficult to be ensured. During specific operation, the left and right baffle plates need to be arranged and fixed on the assembled empty mold, and need to be loosened and removed after feeding; and then the scraper is moved to inject the front and rear steel balls from one of the left and right sides into the concave front and rear steel ball grooves in the outer surfaces of the front and rear templates and horizontally move the steel balls to the other side; therefore, the operation process is complicated and time-consuming. When the cast-in-situ wall core building block is produced by the cover plate and the corresponding operation method thereof in the cast-in-situ wall core building block mold, the rectangular flat frame of the cover plate is provided with the front and rear rectangular hollow sections and a plurality of middle rectangular hollow sections, so that the raw material slurry in the mold is gradually expanded to fill the empty space in the mold after injecting the unfilled foam concrete raw material slurry into the assembled uncovered empty mold and covering with the cover plate; the excess raw material slurry will automatically overflow into the plurality of lower convex semicircular tubes from the front and rear edges of the rectangular hollow section and continue to overflow from one side of the non-blocking semi-cylinder, and cannot overflow from the upper edge of the rectangular flat frame at a higher position. The components forming the inner empty container on the base of the same type of molds can be overlapped in multiple layers from bottom to top, so that the cover plate is pressed by self-weight of the overlapped mold components without influencing gradual expansion and overflow of the raw materials in each layer of mold. A plurality of fixed circular holes are formed in corresponding positions of the front and rear sides of the base and the base plate of the mold, and a plurality of detachable vertical support columns are mounted in circular grooves according to an existing method; and the base plate obtained by detaching the mold and the molding building blocks thereon are overlapped in multiple layers on the base from top to bottom, thereby reducing the occupied area. In actual use, the amount of raw materials injected into the empty mold can be controlled according to experience, thereby reducing overflow of the wastes. The combined type upper surface of the cast-in-situ wall core building block formed after the cover plate is horizontally removed to one side of the non-blocking semi-cylinder is not formed by cutting, but is directly solidified and formed by compacting and polishing the lower surface in contact with the cover plate. The excess raw material slurry at each rectangular hollow section can be shunted into the plurality of lower convex semi-circular tubes by the isosceles right-angle triangle angle steel and the hypotenuse flat plates before compacting and polishing; and the combined type upper surfaces of the several rows and columns of cast-in-situ wall core building blocks formed in the mold may be regular in shape and smooth, thereby improving the quality of the cast-in-situ wall core building blocks. The cover plate is only formed by combining common rectangular flat plates, semi-circular tubes and isosceles right-angle triangle angle steels, is easy to manufacture, and can reduce the left and right baffle plates, the scraper difficult to manufacture and the concave front and rear steel ball grooves in the outer surfaces of the front and rear templates in the configured mold components, thereby reducing manufacturing difficulty and manufacturing cost of the cast-in-situ wall core building block mold. The cover plate does not need to be fixed separately after being covered on the fed uncovered mold, and is horizontally removed to one side of the non-blocking semi-cylinder after the foam concrete in the mold is expanded and molded, thereby realizing simple process and assembling and disassembling operations and convenient use.

BRIEF DESCRIPTION OF THE DRAWINGS

The present invention will be further described below with reference to the accompanying drawing.

The accompanying drawing is a stereogram of the bearing type cover plate corresponding to the minimum unit model wall of the bearing type cast-in-situ wall core building block.

In the FIGURE, 1. the front and rear flat plates of the bearing type cover plate; 2. the left and right added flat plates of the bearing type cover plate; 3. the middle added flat plate of the bearing type cover plate; 4. the front and rear rectangular hollow sections of the bearing type cover plate; 5. the middle rectangular section of the bearing type cover plate; 6. the isosceles right triangle angle steel of the bearing type cover plate; 7. the hypotenuse flat plate of the bearing type cover plate; 8. the lower convex semicircular tube of the bearing type cover plate; and 9. the blocked semi-cylinder of the bearing type cover plate.

What is claimed is:

1. A frame tube recombination cover plate for a cast-in-situ wall core building block mold, comprising bearing type and partition type frame tube recombination cover plates for the cast-in-situ wall core building block mold, wherein the cover plates are covered on assembly and fed uncovered cast-in-situ wall core building block molds to form cover plates with rectangular hollow sections and sealed peripheries; the frame tube recombination cover plate comprises two types of frame tube recombination cover plates for the cast-in-situ wall core building block mold, is made of plastic or metal or a combination of each, and has a length equal to a distance between thickness center lines of left and right templates of two types of short special-shaped cast-in-situ wall core building block molds; inner flat plates of edge plates having a width wider than the inner flat plates and a plurality of middle plates are removed; more than three flat plates perpendicularly connected with the front and rear flat plates and having an equal thickness are equidistantly added between left and right outer edges of the front and rear flat plates at intervals to form a rectangular flat frame; the left and right outer edges of the front and rear flat plates are connected with a plurality of lower convex semi-circular tubes below; hollow sections of semi-cylinders of the plurality of lower convex semi-circular tubes below the flat plates added to one of the left and right sides are blocked and fixed; equal hypotenuses of isosceles right triangle angle steel are respectively fixed at a plurality of middle rectangular hollow sections on inner edge lines at a same side of the flat plates added to one side and the middle of the blocked semi-cylinder; the height of the angle steel is equal to the thickness of the connected flat plate; a hypotenuse flat plate is respectively fixed at front and rear rectangular hollow sections and is connected with two adjacent right-angle-edge flat plates to form a symmetrical congruent isosceles right triangle; and the height of the hypotenuse flat plate is equal to the thickness of the connected flat plate.

* * * * *